US009314388B2

(12) United States Patent
Patrick

(10) Patent No.: US 9,314,388 B2
(45) Date of Patent: Apr. 19, 2016

(54) BODY TRANSPORT APPARATUS

(71) Applicant: James E. Patrick, Plainfield, IL (US)

(72) Inventor: James E. Patrick, Plainfield, IL (US)

(73) Assignee: Sage Products, LLC, Cary, IL (US)

( * ) Notice: Subject to any disclaimer, the term of this patent is extended or adjusted under 35 U.S.C. 154(b) by 0 days.

(21) Appl. No.: 14/810,035

(22) Filed: Jul. 27, 2015

(65) Prior Publication Data

US 2015/0359695 A1 Dec. 17, 2015

Related U.S. Application Data

(63) Continuation of application No. 13/302,703, filed on Nov. 22, 2011, now Pat. No. 9,125,777, which is a continuation-in-part of application No. 11/538,211, filed on Oct. 3, 2006, now Pat. No. 8,276,222, which is a continuation of application No. 11/036,413, filed on Jan. 14, 2005, now Pat. No. 7,114,204.

(51) Int. Cl.

| | |
|---|---|
| ***A61G 7/14*** | (2006.01) |
| ***A61G 7/10*** | (2006.01) |
| ***A61G 1/02*** | (2006.01) |
| ***A61G 7/00*** | (2006.01) |
| ***A61G 7/02*** | (2006.01) |
| ***A61G 7/057*** | (2006.01) |

(Continued)

(52) U.S. Cl.

CPC ..... *A61G 7/1021* (2013.01); *A61G 1/02* (2013.01); *A61G 7/0005* (2013.01); *A61G 7/02* (2013.01); *A61G 7/05769* (2013.01); *A61G 7/103* (2013.01); *A61G 7/1026* (2013.01); *A61G 7/1028* (2013.01); *A61G 7/1034* (2013.01); *A61G 7/1046* (2013.01); *A61G 13/102* (2013.01); *A61G 7/002* (2013.01); *A61G 10/005* (2013.01); *A61G 2007/05784* (2013.01); *A61G 2200/32* (2013.01)

(58) Field of Classification Search

CPC ..... A61G 7/14
USPC ..... 5/81.1 R, 81.1 HS, 706–707
See application file for complete search history.

(56) References Cited

U.S. PATENT DOCUMENTS

| | | | |
|---|---|---|---|
| 1,970,502 | A | 8/1934 | Hamm |
| 3,667,073 | A | 6/1972 | Renfroe |

(Continued)

FOREIGN PATENT DOCUMENTS

| | | |
|---|---|---|
| GB | 2484885 A | 5/2012 |
| WO | WO 2009061850 A 1 | 5/2009 |
| WO | WO 2011028408 A3 | 3/2011 |

OTHER PUBLICATIONS

Dionne, Michael, "Bariatric Ergonomics," Treating the Bariatric Patient, (Jan. 6, 2003), Gainesville, Georgia.

(Continued)

*Primary Examiner* — Fredrick Conley
(74) *Attorney, Agent, or Firm* — Vedder Price P.C.

(57) ABSTRACT

A body transport apparatus including an inflatable air mattress with a plurality of air exit holes on the bottom to provide an air cushion when the mattress is inflated and a cover portion connected to the mattress adjacent a perimeter to define an enclosed volume. The cover portion may include a selectively closeable passageway. A flap may be defined in the cover portion that is movable between open and closed configurations. A plurality of hollows may be defined in the cover portion when inflated to define a body contact area that is less than a surface area of the top surface.

7 Claims, 10 Drawing Sheets

(51) Int. Cl.

| | |
|---|---|
| ***A61G 13/10*** | (2006.01) |
| *A61G 7/002* | (2006.01) |
| *A61G 10/00* | (2006.01) |

(56) References Cited

U.S. PATENT DOCUMENTS

| | | | | |
|---|---|---|---|---|
| 3,705,429 | A | | 12/1972 | Nail |
| 3,739,407 | A | | 6/1973 | Stiller |
| 3,760,899 | A | | 9/1973 | Crossman et al. |
| 3,948,344 | A | | 4/1976 | Johnson et al. |
| 3,959,835 | A | | 6/1976 | Nos |
| 4,090,897 | A | | 5/1978 | Minick |
| 4,272,856 | A | | 6/1981 | Wegener et al. |
| 4,301,791 | A | * | 11/1981 | Franco, III ..... 602/19 |
| 4,528,704 | A | | 7/1985 | Wegener et al. |
| 4,584,989 | A | | 4/1986 | Stith |
| 4,686,719 | A | | 8/1987 | Johnson et al. |
| 4,790,051 | A | | 12/1988 | Knight |
| 4,837,872 | A | | 6/1989 | DiMatteo et al. |
| 4,860,395 | A | | 8/1989 | Smith |
| 4,944,060 | A | | 7/1990 | Peery et al. |
| 4,962,552 | A | | 10/1990 | Hasty |
| 5,044,030 | A | | 9/1991 | Balaton |
| 5,048,134 | A | | 9/1991 | Dennill et al. |
| 5,065,464 | A | | 11/1991 | Blanchard et al. |
| 5,067,189 | A | | 11/1991 | Weedling et al. |
| 5,090,077 | A | | 2/1992 | Caden et al. |
| 5,121,512 | A | | 6/1992 | Kaufmann |
| 5,121,756 | A | | 6/1992 | Koledin |
| 5,235,713 | A | | 8/1993 | Guthrie et al. |
| 5,487,196 | A | | 1/1996 | Wilkinson et al. |
| 5,561,873 | A | | 10/1996 | Weedling |
| 5,568,663 | A | | 10/1996 | Brown |
| 5,699,570 | A | | 12/1997 | Wilkinson et al. |
| 5,742,958 | A | | 4/1998 | Solazzo |
| 5,860,174 | A | | 1/1999 | Failor |
| 5,960,497 | A | | 10/1999 | Castellino et al. |
| 5,996,150 | A | | 12/1999 | Blevins et al. |
| 6,021,533 | A | | 2/2000 | Ellis et al. |
| 6,073,284 | A | | 6/2000 | Borders |
| 6,073,291 | A | | 6/2000 | Davis |
| 6,119,292 | A | | 9/2000 | Haas |
| 6,295,675 | B1 | | 10/2001 | Ellis et al. |
| 6,427,270 | B1 | | 8/2002 | Blevins et al. |
| 6,467,106 | B1 | | 10/2002 | Heimbrock |
| 6,467,113 | B2 | | 10/2002 | Ellis et al. |
| 6,484,334 | B1 | | 11/2002 | Borders et al. |
| 6,598,902 | B2 | | 7/2003 | Keshavaraj |
| 7,107,641 | B2 | | 9/2006 | Davis |
| 7,114,204 | B2 | | 10/2006 | Patrick |
| 7,228,579 | B2 | | 6/2007 | Tidwell |
| 7,303,705 | B2 | | 12/2007 | Panton, Jr. |
| 7,650,654 | B2 | | 1/2010 | Lambarth et al. |
| 2002/0029423 | A1 | | 3/2002 | Ellis et al. |
| 2002/0166168 | A1 | | 11/2002 | Weedling et al. |
| 2003/0000017 | A1 | | 1/2003 | Byerrum et al. |
| 2003/0019042 | A1 | | 1/2003 | Ellis et al. |
| 2003/0070226 | A1 | | 4/2003 | Heimbrock |
| 2003/0159212 | A1 | | 8/2003 | Patrick et al. |
| 2005/0034230 | A1 | * | 2/2005 | Weedling et al. ..... 5/81.1 R |
| 2005/0246864 | A1 | * | 11/2005 | Arakawa ..... 16/277 |
| 2006/0037136 | A1 | | 2/2006 | Weedling et al. |
| 2010/0005593 | A1 | | 1/2010 | Bowling et al. |
| 2012/0131746 | A1 | | 5/2012 | Griffin et al. |
| 2012/0284923 | A1 | | 11/2012 | Jensen et al. |

OTHER PUBLICATIONS

Hovermatt, A D.T. Davis Enterprise, "Patient Handling Technologies, Specializing in Patient Handling & Workers Comp Reduction Programs," (Oct. 1, 2000), Allentown, Pennsylvania.

Plexus Medical, "Low Air Loss/APM Therapy System Operating Instructions," Feb. 2, 2000.

* cited by examiner

BODY TRANSPORT APPARATUS

This application is a continuation of and claims the benefit of and priority from U.S. application Ser. No. 13/302,703, filed Nov. 22, 2011, which is a continuation-in-part of U.S. application Ser. No. 11/538,211, filed Oct. 3, 2006, now U.S. Pat. No. 8,276,222, issued Oct. 2, 2012, which is a continuation of U.S. application Ser. No. 11/036,413, filed Jan. 14, 2005, now U.S. Pat. No. 7,114,204, issued Oct. 3, 2006, all of which are hereby fully incorporated herein by reference.

The present disclosure relates generally to a body transport apparatus, and more particularly to an inflatable mattress for moving a body on a cushion of air that has an enclosed volume above the mattress.

BACKGROUND

Non-ambulatory patients or bodies that must be supported and moved in a facility such as a hospital, nursing home, morgue, funeral home, emergency scene, remote rescue location, or the like, etc. present substantial challenges when a the patient or body must be moved from one location to another. A patient, for example, may need to be moved from a hospital bed, which must remain in the patient's room, to a stretcher and then from the stretcher to a treatment location such as a surgical table in an operating room. Following treatment the reverse patient handling sequence must occur; i.e., the patient must be moved from the surgical table, which remains in the operating room, to a stretcher which travels to the patient's hospital room, and then from the stretcher back onto the bed in the hospital room. Likewise, the body of a patient that has expired may need to be moved from an operating table to a stretcher for transport to the morgue. Then from the stretcher to the examination table.

In a very large percentage of such occurrences the patient or body must be handled in a fashion which requires only a minimum of movement with respect to a supporting surface. In the case of a patient being returned to a hospital room following surgery, for example, the patient's body may not be able to withstand the stresses and strains of being lifted from a stretcher to the bed when one or even several hospital personnel combine they efforts to make such a transfer. Alternatively, the patient may require minimal contact with the supporting surface in order to provide a therapeutic effect, such as with burn patients.

The same challenge of moving a patient or body with minimum handling exists in non-surgical settings as well. The bariatric patient is a prime and very common example. When such a patient is morbidly obese, transferring presents difficulties for both the patient or body and the care facility staff. While no exact definition of morbid obesity is universally recognized, many hospitals and other treatment facilities consider a person who weighs about 350 pounds or more to fall within that definition.

Movement of a morbidly obese person often requires the hospital staff to physically lift and/or slide the patient from an at rest position on a hospital bed to an at rest position on a stretcher a total of four times to complete a single treatment cycle, such as surgery. The staff must perform the task of lifting and/or sliding such a patient because in nearly all instances the patient, due to the physical condition of obesity and/or illness, simply cannot personally do the task. The manipulation of such a person requires a plurality of hospital staff since such manipulation is impossible to perform by a single person such as a floor nurse assigned to the patient's room. As a consequence, such transfers must be planned in advance for a specific time and a number of hospital staff must be notified and arrange their schedules so that all staff will be available at the same time. As is well known, many hospital staff are females and many of these persons are rather slight of stature. As a result, a half dozen or more such persons may need to be assembled. Instances have been known in which a morbidly obese patient has required twelve persons to effect the transfer. Gathering together such a large number of people four times at often uncertain intervals to provide but a single cycle of treatment raises obvious logistical problems and, in addition, erodes the quality of care the facility can render by reason of the application of such a large number of personnel to deal with but a single patient treatment episode.

The same challenges and drawbacks remain with respect to the storage and transport of the remains of a deceased body to be able to move the body as described above and provide dignity to the remains as the body is moved throughout the hospital, nursing home, funeral home, or the like, etc. Additionally, the collection of waste and drainage from the body is not accounted for in conventional apparatus.

Even further drawbacks have been discovered when special circumstances require heightened comfort for the patient and minimized skin compromise. For example, in those circumstances where patients with skin conditions require frequent turning or movement to avoid the formation of sores or the like, staff interaction is increased and the disadvantages mentioned herein are amplified, in addition to the need to move such a patient.

A further drawback to such a patient handling system as above described is that, even with the best intentioned and caring of staff, the patient very often suffers substantial discomfort. The simple act of sliding a patient over a flat surface can be very painful to a patient who has had surgical incisions which are far from healed, for example.

An attempt has been made to overcome the above described problems by the use of an air mattress onto which the patient is placed while in his bed and which is then placed onto a wheeler. A problem common to all such devices is that invariably the air mattress has the general characteristic of a balloon, in the sense that when one area is indented another remote area will bulge, thus creating an unstable condition. If for example a stretcher carrying an obese person makes a sharp turn during a trip to or from a treatment location, such an obese person will tend to roll toward the outside of the turn due to the instability of such a conventional mattress. The more the patient rolls, the more the mattress portion toward which the rolling movement occurs will depress, and the greater will be the expansion of the mattress on the other side of the patient. In effect, the conventional mattress reinforces the undesirable rolling movement and is unstable. Since much of the time the patient is incapable of stopping the rolling action by himself, the patient may roll off the stretcher onto the floor with disastrous consequences. Indeed, even in the instance of a patient who is capable of moving himself to some degree about his longitudinal body axis the same disastrous result may occur because the displacement of air from one edge portion of the mattress to the opposite edge portion creates in effect a tipping cradle. Only if the patient lies perfectly flat and perfectly still on the stretcher, and no roadway depressions or blocking objects, such as excess hospital beds stored in a hallway, are encountered can the probabilities of an accident be lessened.

Another problem with prior art methods of moving patients using an air cushion is the complexity of the procedure. The air mattress must first be positioned under the patient. Then an air pump must be transported to the bed area and connected to the mattress. The mattress is then inflated and the patient moved. The same process is repeated each time the patient needs to be transferred from one bed/stretcher/table to another.

A still further problem with prior art apparatus is control of contamination. Often, a tedious cleaning protocol follows after such use to avoid cross-contamination. Cleaning is particularly difficult because contaminant particles can penetrate into the mat material, and when the mat is inflated, the pressure can force the particles out and into the air. The high cost of prior art air cushions requires their re-use.

A yet further problem with prior art apparatus is the lack of dignity afforded the remains of a deceased body. The body is usually transferred to a stretcher then draped in a sheet or must be lifted into a conventional body bag. Up arrival at the morgue and/or funeral home the body must be removed for cleaning. All the while, being transferred from one surface to another by lifting. Still yet a further problem with prior art apparatus is the amount of skin or body contact area that requires frequent movement of the patient, not only lateral transfer as explained above, but rotation or change of position to avoid compromising the skin during the healing process. Moreover, another disadvantage of the prior art is the inability to use such inflatable mattress in an uninflated state.

Therefore, there is a need in the art for a body transport apparatus that overcomes the disadvantages of the prior art and provides the advantages as described in this disclosure.

BRIEF DESCRIPTION OF THE DRAWINGS

The following disclosure as a whole may be best understood by reference to the provided detailed description when read in conjunction with the accompanying drawings, drawing description, abstract, background, field of the disclosure, and associated headings. Identical reference numerals when found on different figures identify the same elements or a functionally equivalent element. The elements listed in the abstract are not referenced but nevertheless refer by association to the elements of the detailed description and associated disclosure.

DETAILED DESCRIPTION

Figure 1:
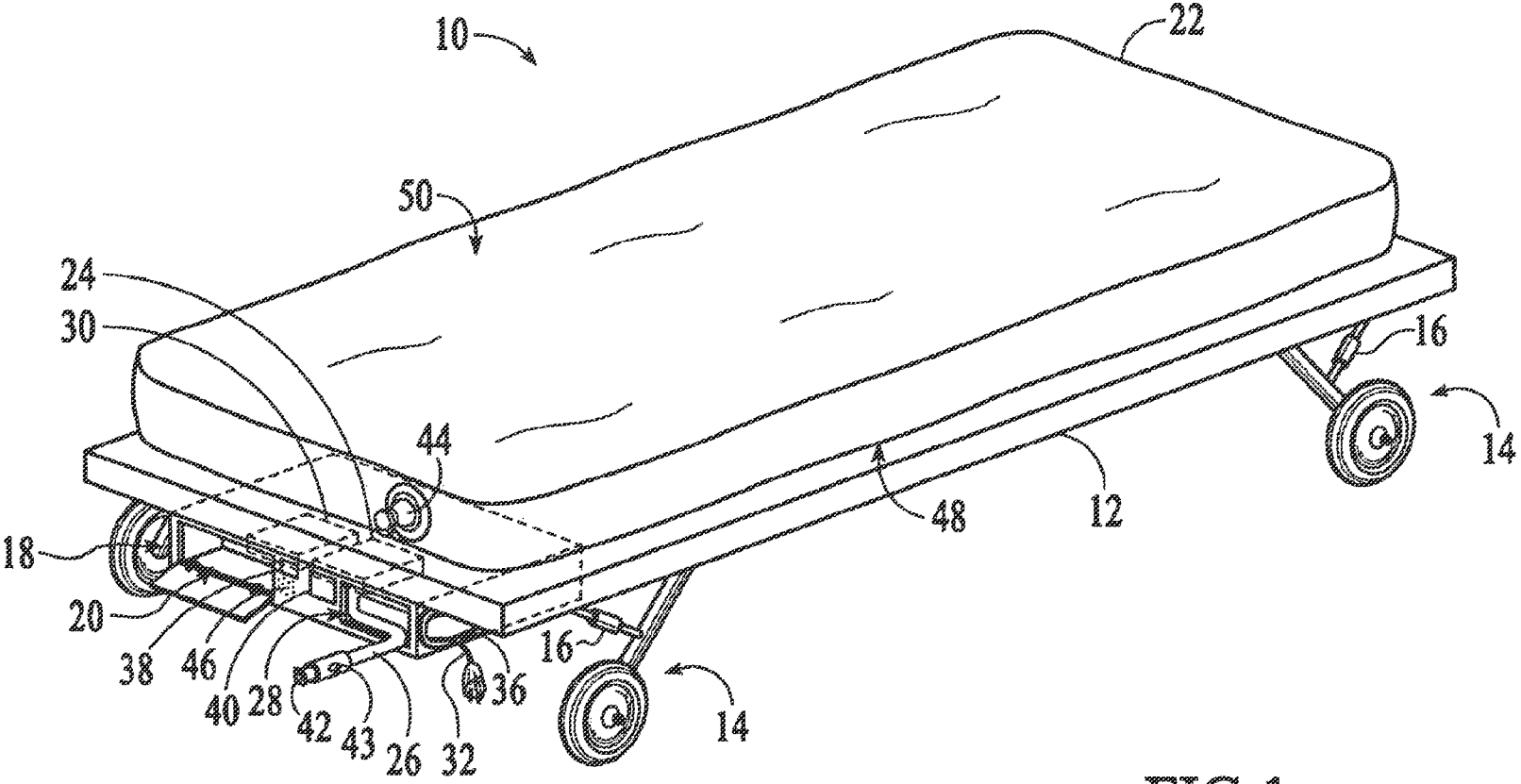
FIG. 1 illustrates an integrated patient transfer system according to the present disclosure as applied to a stretcher.

The present disclosure is not limited to the particular details of the apparatus depicted, and other modifications and applications may be contemplated. Further changes may be made in the apparatus, device or methods without departing from the true spirit of the scope of the disclosure herein involved. It is intended, therefore, that the subject matter in this disclosure should be interpreted as illustrative, not in a limiting sense.

In one aspect of the present disclosure, a body transport apparatus may include an mattress with a plurality of holes on the bottom to provide an air cushion when the mattress is inflated and a cover portion connected to the mattress to define an enclosed volume. The cover portion may include a selectively closeable passageway. A flap may be defined in the cover portion that is movable between open and closed configurations. A plurality of hollows may be defined in the cover portion when inflated to define a minimal body contact area.

In another aspect of the present disclosure, a body transport apparatus may include an inflatable air mattress having a top portion and a bottom portion. The bottom portion may include a plurality of holes configured to provide an air cushion under the mattress when the mattress is inflated. A cover portion may be connected to the mattress to cooperatively define with the top portion an enclosed volume above the top portion. The cover portion may include a selectively closeable passageway. A flap may be defined in the cover portion that includes a fold line disposed adjacent a perimeter of the top portion and may be movable about the fold line between a first position defining an open configuration to provide access through a defined opening to the enclosed volume and a second position defining a closed configuration to prevent access to the enclosed volume.

In yet another aspect of the present disclosure, a closure assembly may connected to the flap and the defined opening to connect and disconnect the flap and the defined opening. The closure assembly may be a zipper, hook and loop fastener or the like, etc. The passageway may be defined by a drain connected to the cover portion that may include a selectively removable cover to facilitate retention of fluid within the enclosed volume. A stabilizing board may be releasably connected to the top portion of the mattress and apparatus for securing a body to the board. The mattress may include a marking for indicating that the bottom portion is to be positioned downward. The marking may include the bottom portion colored dark relative to the top portion. The top portion of the mattress may have a color of white for ease of observing fluids. The cover portion may be opaque, a black color or the like, etc.

In yet another aspect of the present disclosure, a body transport apparatus may include an inflatable air mattress including a top surface and a bottom surface that may include a plurality of exit holes configured to provide an air cushion under the mattress when the mattress is inflated. A first receptacle may be integrated into the mattress for connection to a supply of gas. A cover portion may be connected to the mattress adjacent a perimeter of the top portion to define an enclosed volume. The cover portion may include a plurality of hollows by connection of a plurality of preselected portions of the top surface to the top portion to define a minimal body contact area. A second receptacle may be integrated into the cover portion for connection to a supply of gas. The mattress may be separately and independently inflatable from the enclosed volume.

In still yet another aspect of the present disclosure, the second receptacle may include a cover to seal the enclosed volume after inflation in order to maintain the enclosed volume in an inflated state regardless of a state of inflation of the mattress. A ratio of the body contact area to surface area may be less than 50% or less than 20%. The body contact area may be defined as that portion of the top surface that is disposed above the top portion at a distance of at least 90% of a vertical extent of the side surface.

In yet another aspect of the present disclosure, a body transport apparatus may include an inflatable air mattress including a top portion and a bottom portion that includes a plurality of air exit holes configured to provide an air cushion under the mattress when the mattress is inflated and a plurality of straps. The plurality of straps may include a plurality of end straps connected at a proximal end to the bottom portion and having a free distal end and a plurality of side straps connected at a central portion to the bottom portion and having a pair of free distal ends. The side straps may have a length greater than a width of the mattress In still another aspect of the present disclosure, a molded handle may be disposed at the end of each strap. Each strap may have a color of safety neon orange. The side straps may extend across the width of the mattress without interference with the air exit holes.

Briefly, a preferred embodiment of the present invention includes a patient transfer apparatus including an inflatable mattress, alternatively with a rigid top board with a patient restraint system on which a patient can be placed when patient immobilization is required. A portable cart is included with a chamber for storage of a plurality of mattresses. The cart also has a gas/air blower and power supply system for empowering the blower. The power system includes provision for drawing power from line AC/DC, and has a rechargeable battery and charger for maintaining the battery by connecting the supply to the line AC/DC. The mattress has a perforated bottom surface for exit of air to provide an air cushion, and is constructed with a white top surface and a dark bottom surface for optimum recognition of contamination, and identification of the bottom surface which must be placed downward. The cart is coated with an antimicrobial substance to minimize the risk of contaminants.

An embodiment of the system 10 of the present invention is shown in FIG. 1 as applied to a stretcher 12. The stretcher 12 can be of any type, such as used in a hospital or an ambulance, and can have fixed height legs 14 or adjustable height as indicated symbolically by adjusters 16. According to the system of the present invention, a patient bed illustrated as a stretcher 12 in FIG. 1 is assembled with an air mattress air supply system 18 attached. The term "air" as used in the present disclosure is meant to refer to air or any other gas that can be used to inflate an inflatable mattress. "Air mattress" therefore refers to a mattress that can be inflated with any such gas. Although the bed is illustrated as a stretcher, the present invention includes any type of bed/surface for supporting a patient, and will be referred to as a bed apparatus including any form of patient support apparatus, such as a stretcher or hospital bed, etc. The supply system 18 has a compartment 20 for storage of one or more air mattresses such as air mattress 22 for placement a bed/stretcher 12. The supply system 18 has included a gas/air blower 24, a gas/air hose 26 and apparatus for storing the hose 28. A power supply 30 is included, having a rechargeable battery and recharging supply. A power cord 32 and cord storage 36 is provided. The cord 32 can be plugged into an AC outlet for running the blower, and/or simply for charging the battery. With the battery charged, the blower can be operated without the need to plug the cord into an outlet. The supply 30 has an on-off switch 38, and alternatively a display/indicator 40 for showing the degree of charge on the supply battery. The hose 26 has a connector 42 on a distal end for connection to a receptacle 44 on the air mattress 22. As a further embodiment, an alternative power switch 43 is provided near the connector 42. As an alternate embodiment, various portions of the system 10 may be coated in part or totally with an antimicrobial coating, indicated symbolically with dots in FIG. 1 on a portion 46.

The air mattress 22 is constructed with small holes in the bottom surface 48 to allow gas to exit from inside the mattress 22 so as to create an air cushion for levitating the air mattress. As an alternate embodiment, the bottom surface with the holes is marked to indicate that it is to be placed downward. The top surface 50 is preferably a very light color, more preferably white to more easily observe contamination. The purpose of the very light top surface is to allow operating personnel to more easily identify contamination on the top surface. A substantial portion of the air mattress 22 (approximately 90%) is preferably constructed of nylon, and as a result is less expensive to fabricate than prior art air mattresses. The low cost, disposable air mattress of the present invention is a major improvement in sanitation for an inflatable air mattress, since contaminant particles can become embedded in the air mattress material Which makes cleaning difficult. This is a particular problem because when an air mattress is inflated, the gas pressure forces contaminants from the material, making them air borne.

The inflatable air mattress 22 can be positioned on a firm surface or alternatively the air mattress 22 can be placed either on top of or under a non-inflatable mattress. These alternative positions are illustrated more dearly in a planar view, as shown and discussed in reference to FIG. 7.

Figure 2:
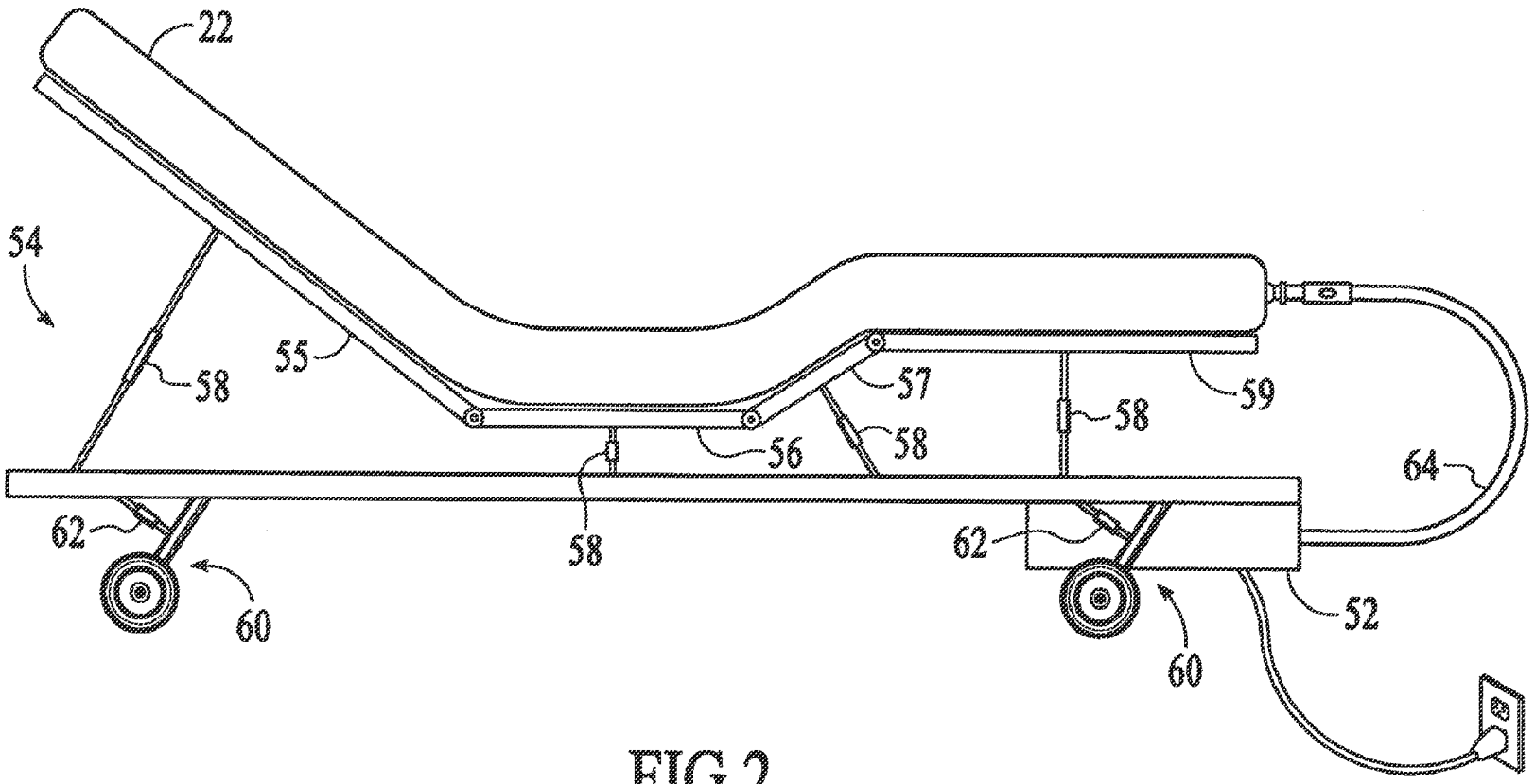
FIG. 2 illustrates an integrated patient transfer system according to the present disclosure as applied to a hospital bed.

FIG. 2 illustrates the integration of a supply system 52 on an adjustable hospital bed 54. The supply system 52 has the features of the supply system 18 that is integrated on the stretcher of FIG. 1. The bed 54 and stretcher 12 are only symbolically illustrated. Those skilled in the art will know how to construct a stretcher and adjustable hospital bed. The present invention includes the combination of any stretcher or bed with a supply system attached/integrated such as supply 18 or 52. Planar items 55, 56, 57, 59 and adjusters 58 are symbolically shown to indicate an adjustable patient surface, and optional adjustable legs are indicated symbolically by legs 60 and adjusters 62. A hose 64 is shown connected to the air mattress 22. The air mattress 22 shown in FIG. 2 is shown placed on firm planar elements/items 55 59. The mattress 22 of FIG. 2 can also be placed on top of or under a non-inflatable mattress in a similar way as that described in reference to FIG. 1, and shown and described in reference to FIG. 7.

Figure 3:
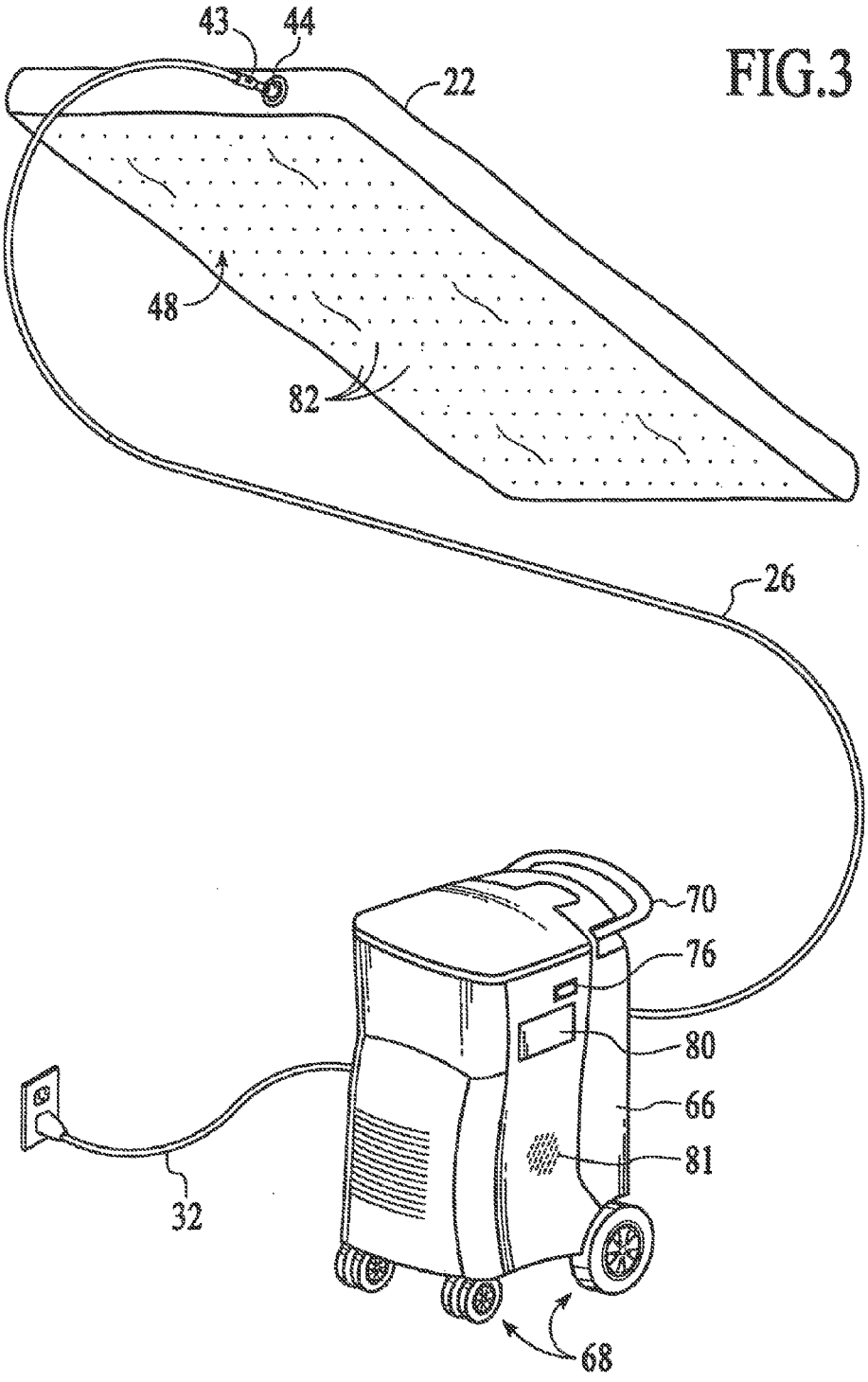
FIG. 3 illustrates an air cushion and supply cart according to the present disclosure.

An alternate embodiment of the present invention is illustrated in FIG. 3 for use in applying the system to existing beds. In this embodiment, a portable supply cart 66 is provided for supplying air to an air mattress 22. The cart 66 has wheels 68 and a handle 70 for convenient portability. The cart 66 also has features similar to those described in reference to the supply 18 of FIG. 1, including a storage compartment for storage of one or more air mattresses 22, a rechargeable power supply, a hose 26 and power cord 32, one or more on-off switches located either at 76 or 43 or at both positions, and alternatively a display 80 for showing the degree of charge on a rechargeable battery cart inside and outside included in the cart 66. As an alternate embodiment, the cart 66 can have an antimicrobial coating 81 on part or all of the cart inside and outside surfaces. An antimicrobial surface in the mat storage chamber 86 (FIG. 4) helps maintain the sanitary condition of a mat or mats stored therein prior to their use on a bed. The view of the air mattress 22 of FIG. 3 allows illustration of the bottom surface 48 and the holes for exit of gas/air, noted as items 82.

Figure 4:
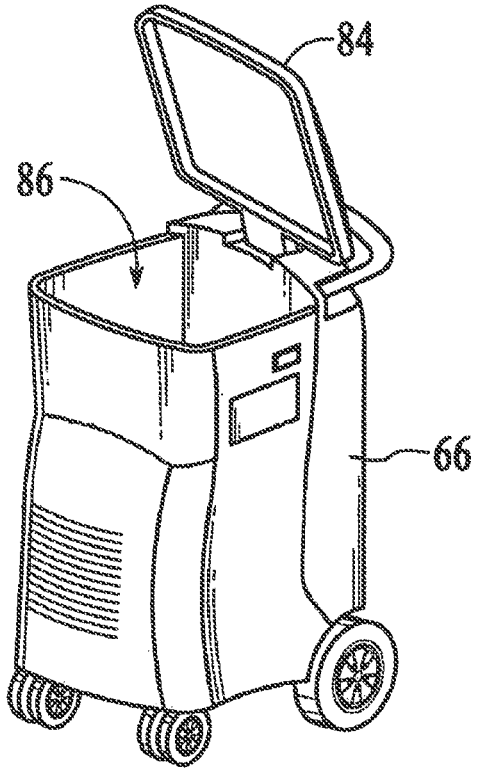
FIG. 4 illustrates an air cushion storage section of the cart of FIG. 3.

FIG. 4 shows a view of the cart 66 with a lid 84 open to show enclosure/compartment 86 for storing one or more air mattresses 22.

Figure 5:
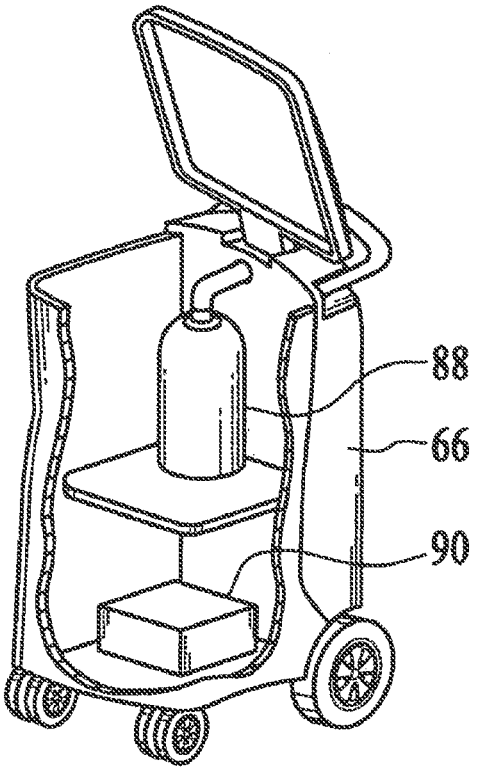
FIG. 5 is a sectional view of the cart of FIG. 3 for illustrating an air blower and power supply.

FIG. 5 is a sectional view of the cart 66 for showing a gas/air blower 88 and a power supply 90 as part of the cart 66. The blower 88 and supply 90 have the same functions as the blower 24 and supply 30 of FIG. 1.

Figure 6:
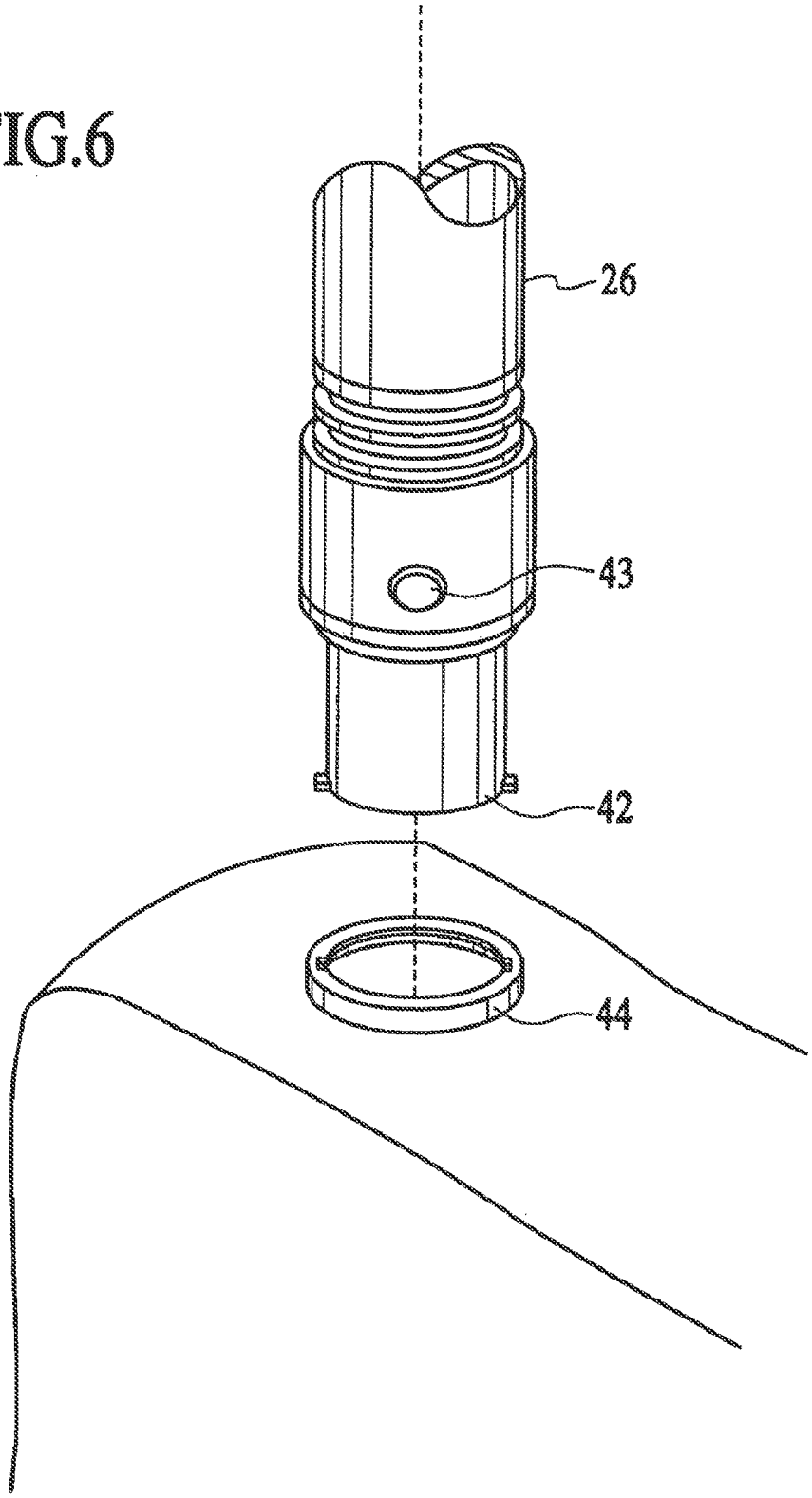
FIG. 6 illustrates interconnecting apparatus for attaching an air supply hose to the mat.

FIG. 6 provides a more detailed view of the receptacle 44 and connector 42 introduced in reference to FIG. 1. This connector and receptacle combination is an improvement over prior art apparatus used to connect to inflatable mattresses for providing an air cushion for moving patients. The prior art connections are made with hook and loop material that can harbor contamination. The nonporous surface of the material of the apparatus of FIG. 6 is more sanitary since it can be easily cleaned.

Figure 7:
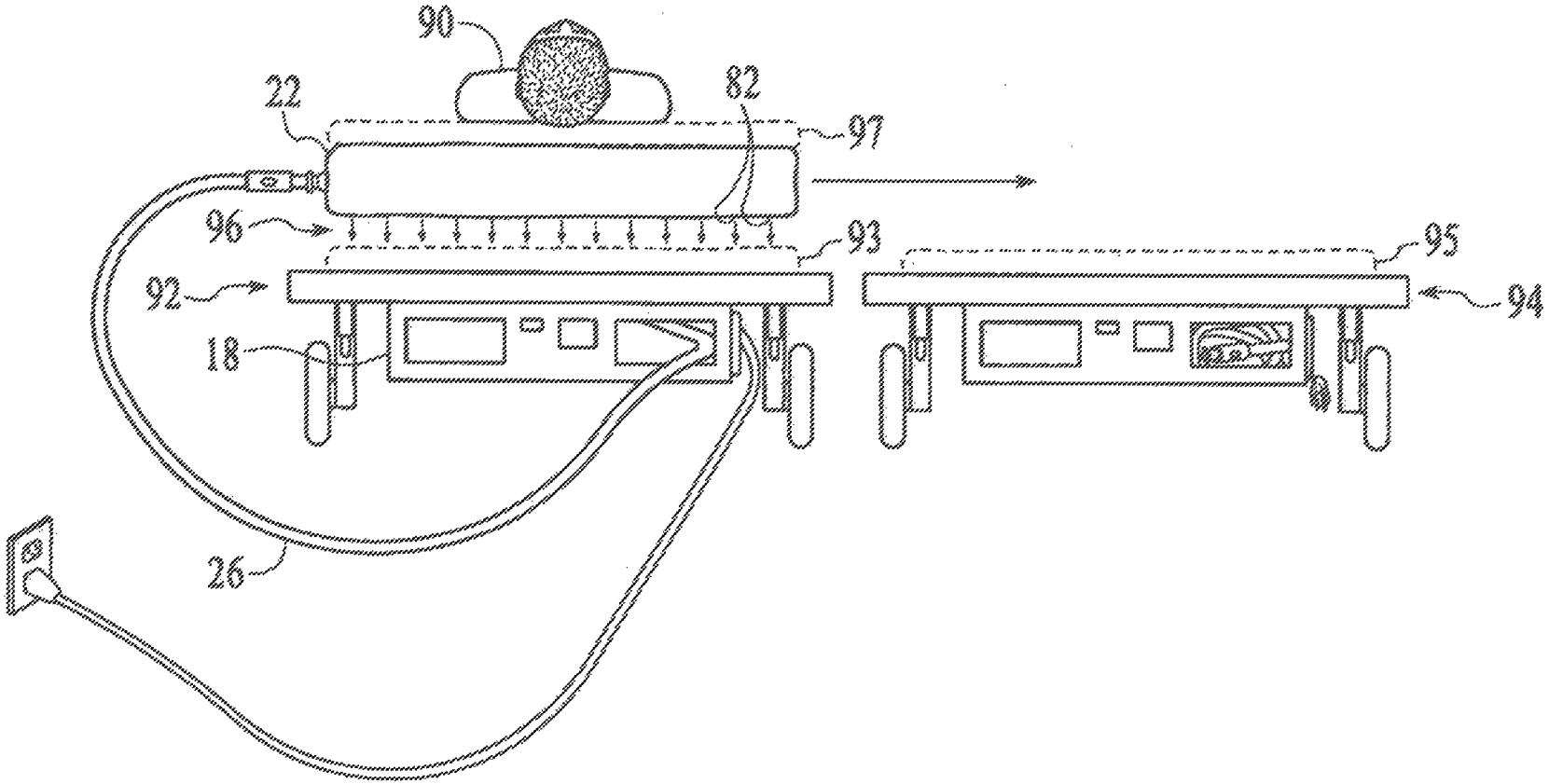
FIG. 7 illustrates patient movement between beds.

FIG. 7 illustrates a system of the present invention in operation. A patient 90 is on a first bed apparatus 92, and is to be moved onto an adjacent second bed apparatus 94. The patient 90 has been placed on an inflatable mattress 22 for providing an air cushion 96, and the supply system 18 has the hose 26 connected to the air mattress 22 and is supplying a gas, a portion of which is forced out exit holes 82, causing the air mattress 22 to float on a cushion of air/gas 96. An attendant can at this stage, move the air mattress 22 with patient over onto the bed 94. The planar view of FIG. 7 is also used in the present disclosure to illustrate placing the air mattress either above or below a non-inflatable mattress. Dashed outline 93 illustrates a non-inflatable mattress on which air mattress 22 is placed. A similar non-inflatable mattress 95 can also be placed on bed 94. Alternatively, the air mattress 22 can be placed under a non-inflatable mattress 97 upon which the patient 90 is placed. Any combination of inflatable air mattresses as described herein with non-inflatable mattresses on any of the various beds described in the present disclosure are included in the present invention.

Figure 8:
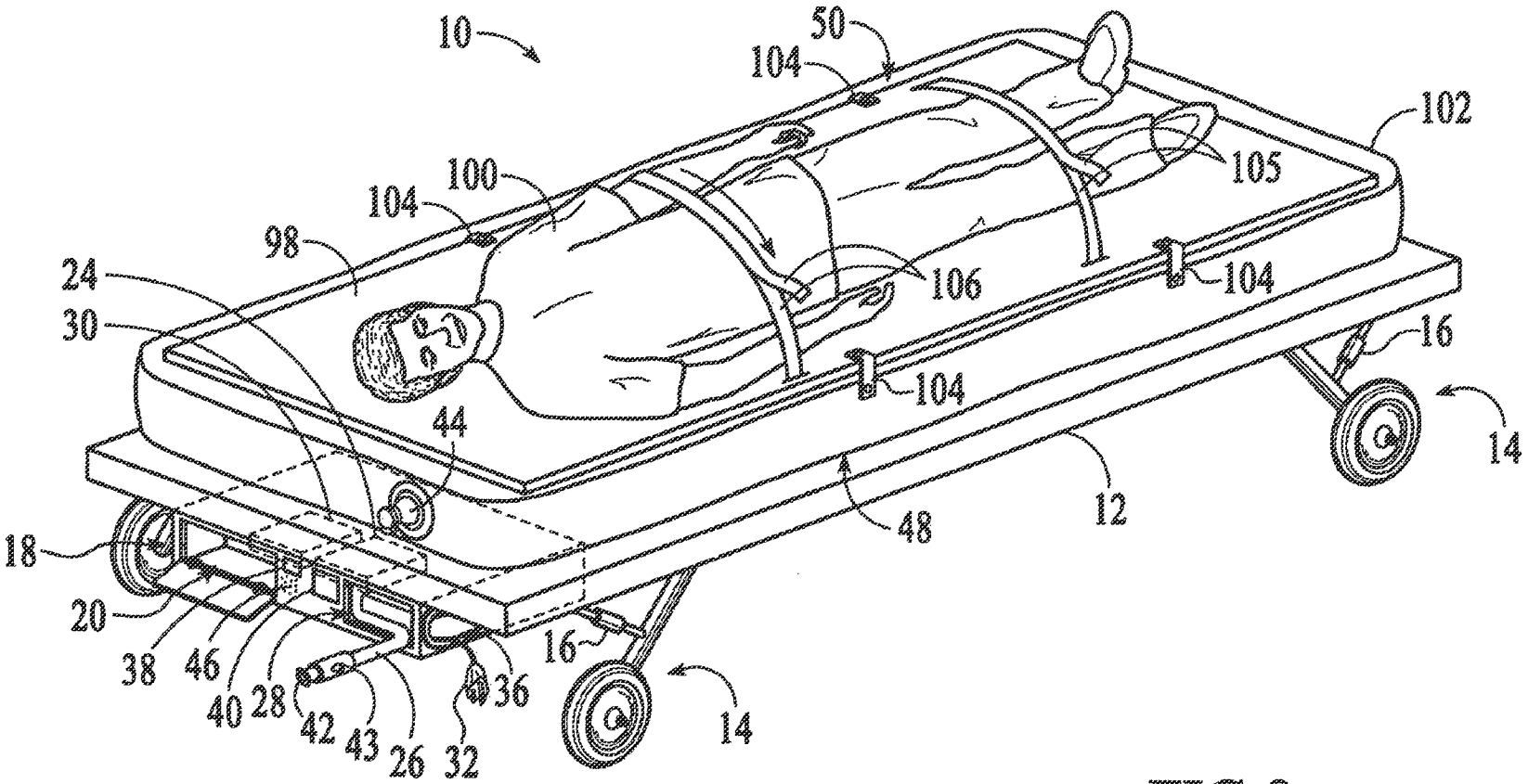
FIG. 8 illustrates a board with the inflatable mattress.

FIG. 8 shows a bed with the inflatable mattress and supply system similar to that displayed in FIG. 1, except for the addition of a board 98 for stabilization of a patient 100. The board 98 is shown attached to the inflatable air mattress 102 with fasteners 104. Other methods for attaching/retaining the board 98 to the mattress 102 will be apparent to those skilled in the art, and these are also included in the spirit of the present invention. One example of another method of retaining the board would be to insert it in a pocket attached to or integral with the mattress 102. For further stabilization of the patient 100, straps 105 and 106 may be included, attached to the board 98 as shown, or to the mattress 102. A board as described with the attachment can be used whenever the inflatable mattress is used, in all of the applications as described in the present disclosure. The mattress 102 may be placed directly on the firm surface of the stretcher 12, or on a similar surface of a hospital bed, or it can be placed over a non-inflatable mattress as described in reference to FIG. 7.

Figure 9:
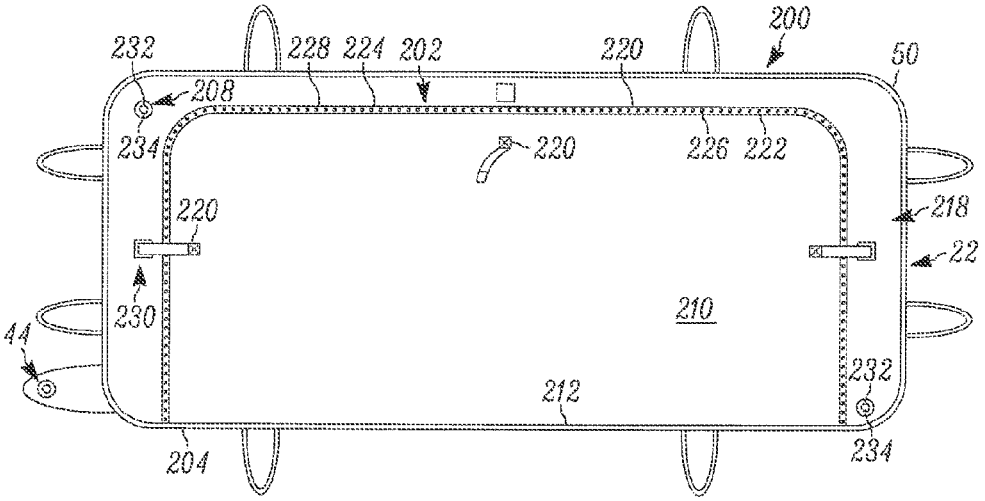
FIG. 9 illustrates a top view of a body transport apparatus in accordance with one embodiment of the present disclosure.
Figure 10:
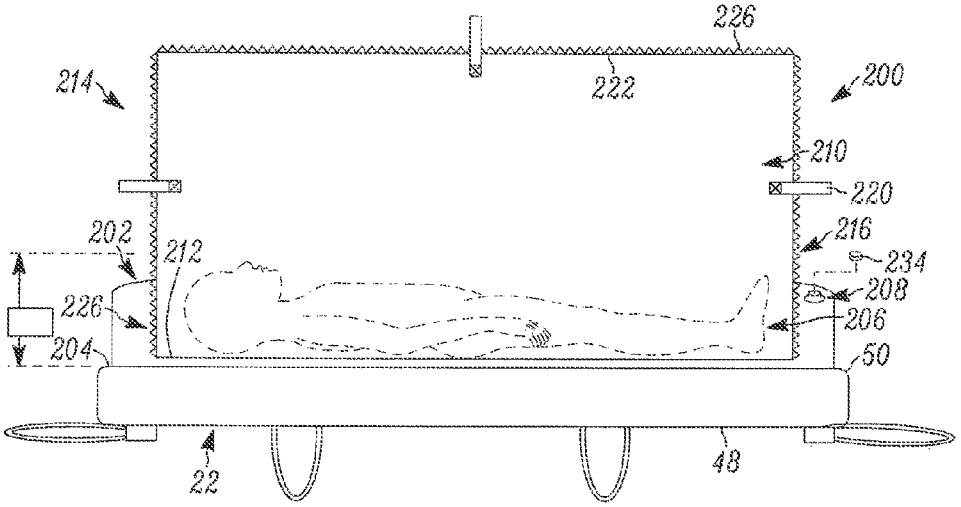
FIG. 10 illustrates a side view of the body transport apparatus of FIG. 9.
Figure 11:
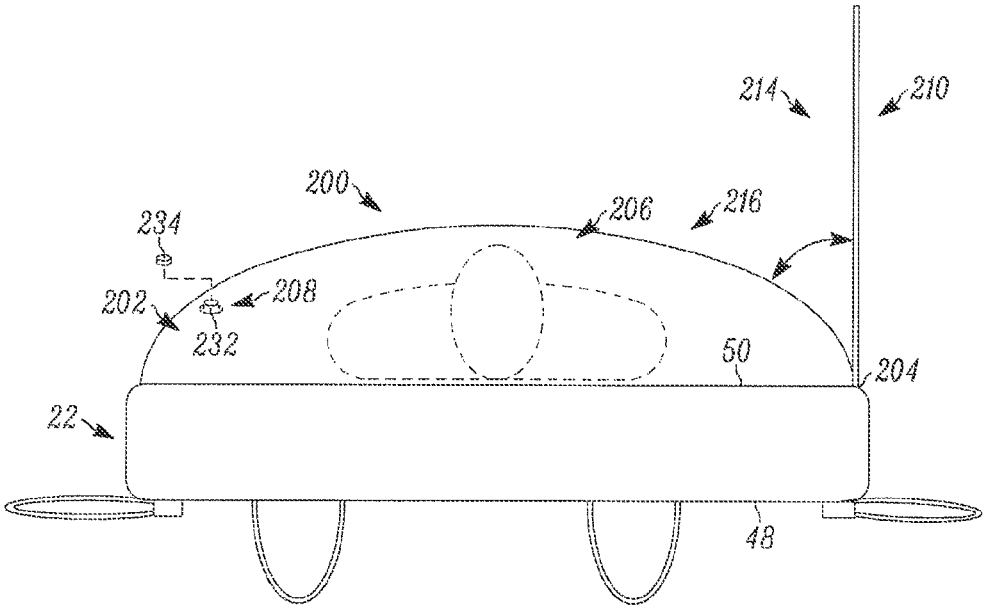
FIG. 11 illustrates an end view of the body transport apparatus of FIG. 9.

FIGS. 9-11 illustrate a body transport apparatus 200 in accordance with one embodiment of the present disclosure. The body transport apparatus 200, in this embodiment, may include an inflatable air mattress 22 including a top portion 50 and a bottom portion 48. The bottom portion 48 may include a plurality of air exit holes 82 configured to provide an air cushion under the mattress 22 when the mattress 22 is inflated. A cover portion 202 connected to the mattress 22 adjacent a perimeter 204 of the top portion 50 to cooperatively define with the top portion an enclosed volume 206 above the top portion 50. The cover portion 202 may include a selectively closeable passageway 208. A flap 210 may be defined in the cover portion 202 and may include a fold line 212 disposed adjacent the perimeter 204 of the top portion 50. The flap 210 may be movable about the fold line 212 between a first position defining an open configuration 214 to provide access through a defined opening 216 to the enclosed volume 206 (see FIGS. 10 and 11) and a second position defining a closed configuration 218 to prevent access to the enclosed volume 206 (see FIG. 9). A receptacle 44 may be disposed on a flange extending from the mattress 22 to facilitate connection to an air supply and remain away from contact with the body or patient when the mattress is inflated, which is a benefit over the prior art. A closure assembly 220 may be connected to a perimeter of the flap 222 and the perimeter of the defined opening 224 that is selectively engagable in a first orientation wherein a first portion 226 of the closure assembly 220 connected to the flap 210 is disconnected from a second portion 228 of the closure assembly 220 connected to the defined opening 216 (see FIGS. 10 and 11) and a second orientation wherein the first portion 226 is connected to the second portion 228. The structure of the closure assembly 220 may be selected from the group consisting of a zipper, a hook and loop fastener 230, or the like, etc. to perform the intended functionality. The passageway 208 may be defined by a drain 232 connected to the cover portion 202 that may also include a selectively removable cover 234 to facilitate retention of fluid within the enclosed volume 206. The passageway may be welded to the cover portion and be constructed with a ¾" internal diameter. A stabilizing board 98 may be releasably connected to the top portion 50 of the mattress 22 and apparatus 105, 106 for securing a body 100 to the board 98, as shown in FIG. 8 and described herein. In one embodiment, the cover portion 202 may be opaque, have a black color or the like, etc. In one embodiment, the cover portion may be constructed of a black 4 ounce vinyl, the top portion may be constructed of a white 10 ounce PVC coated nylon and the bottom portion may be constructed of a royal blue 10 ounce PVC coated nylon. The body transport apparatus of this embodiment may be used to collect waste and drainage from the body. The drain passageway's facilitate collected of such fluids generated during the wash down of the body and as a result of decomposition. After the body has been washed when disposed atop the body transport apparatus of this embodiment and all fluids collected in the enclosed volume, the covers may be applied to the drains. The mattress is log rolled under the body such that the body may be fully disposed and contained within the enclosed volume. When the body needs to be transported, the air supply is connected to the receptacle to inflate the mattress.

Figure 12:
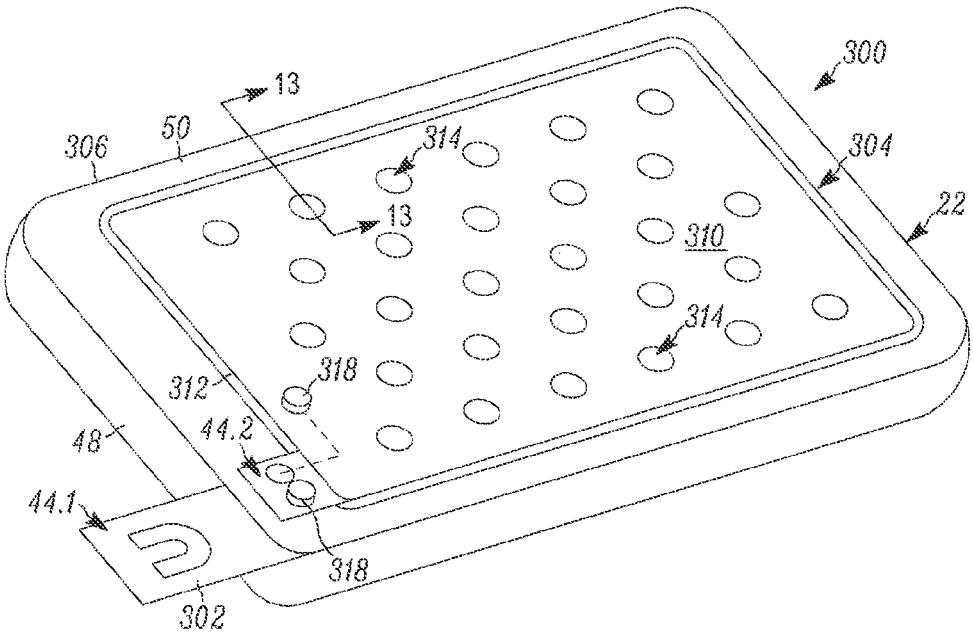
FIG. 12 illustrates a perspective view of a body transport apparatus in accordance with another embodiment of the present disclosure.
Figure 13:
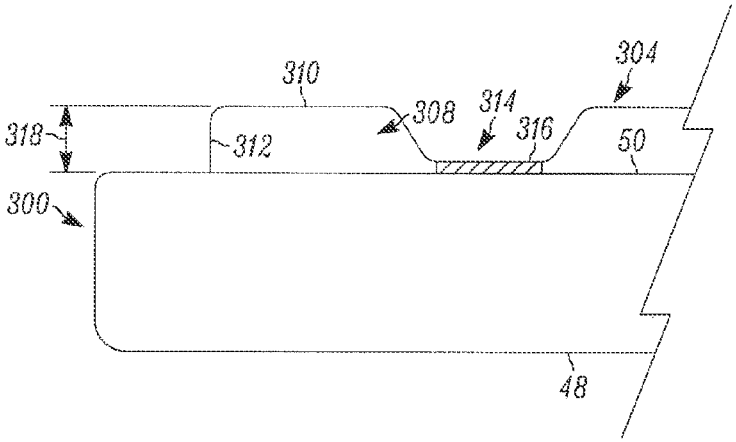
FIG. 13 is a sectional view of the body transport apparatus of FIG. 12 taken along line 13-13.

FIGS. 12 and 13 illustrate a body transport apparatus 300 in accordance with another embodiment of the present disclosure. The body transport apparatus 200 of this embodiment may include an inflatable air mattress 22 including a top surface 50 and a bottom surface 48 that may include a plurality of air exit holes 82 configured to provide an air cushion under the mattress 22 when the mattress 22 is inflated. A first receptacle 44.1 may be integrated into the mattress 22 or a flange 302 that extends from the mattress 22 for connection to a supply of gas as described herein. A cover portion 304 may be connected to the mattress 22 adjacent a perimeter 306 of the top portion 50 to cooperatively define with the top portion 50 an enclosed volume 308 above the top portion 50. The cover portion 304 may include a top surface 310 and a side surface 312. A plurality of hollows 314 may be defined in the cover portion 304 when inflated by connection of a plurality of preselected portions of the top surface 316 to the top portion 50 to define a body contact area of the top surface that is less than a surface area of the top surface 310. A second receptacle 44.2 may be integrated into the cover portion 304 for connection to a supply of gas as described herein. Preferably, the mattress 22 is separately and independently inflatable from the enclosed volume 308. The second receptacle 44.2 may include a cover 318 to seal the enclosed volume 308 after inflation to maintain the enclosed volume 308 in an inflated state regardless of a state of inflation of the mattress 22. The cover 318 may include a cap connected to the second receptacle 44.2, a self-closing flap disposed within the opening of the second receptacle 44.2 that is normally closed except when connected to the connector at the distal end of the hose, or the like, etc. In one embodiment, a ratio of the body contact area to surface area is less than 50%. In another embodiment, the ratio of the body contact are surface area is less than 20%. The body contact area may be defined as that portion of the top surface 310 that is disposed above the top portion 50 at a distance of at least 90% of a vertical extent 318 of the side surface 312. The body transport apparatus of this embodiment may be log rolled under the patient. The air supply is then used to inflate the cover portion and once the desired comfort level for the patient is achieved, the air supply may be disconnected and the cover applied to the second receptacle. When the patient needs to be transported, the air supply is connected to the first receptacle to inflate the mattress and the patient may be moved as described herein.

Figure 14:
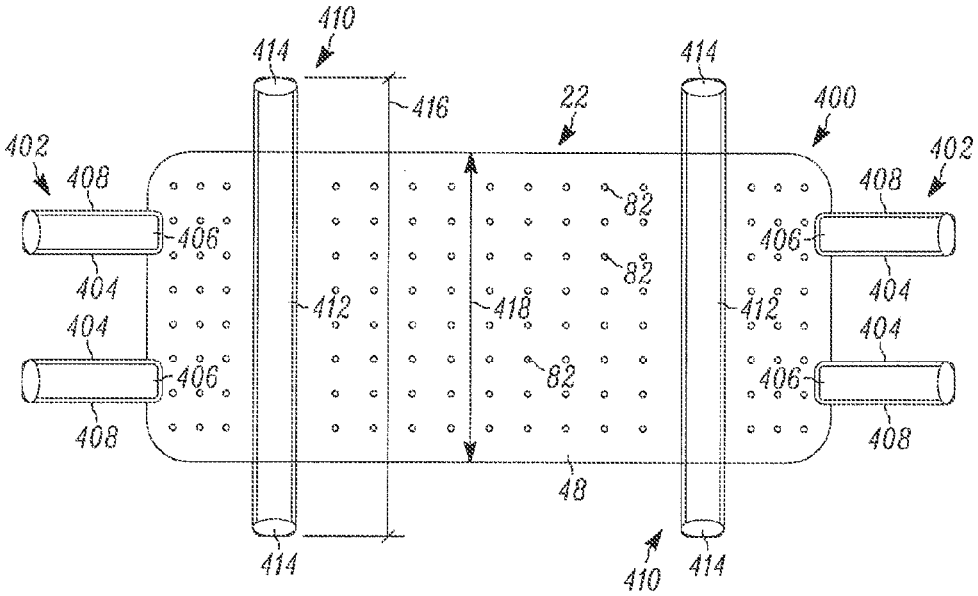
FIG. 14 illustrates a bottom view of a body transport apparatus in accordance with another embodiment of the present disclosure.

FIG. 14 illustrates a bottom view of a body transport apparatus 400 in accordance with another embodiment of the present disclosure. The body transport apparatus 400 in this embodiment may include an inflatable air mattress 22 including a top portion 50 and a bottom portion 48 that may include a plurality of air exit holes 82 configured to provide an air cushion under the mattress 22 when the mattress 22 is inflated and a plurality of straps 402 that may include a plurality of end straps 404 connected at a proximal end 406 to the bottom portion 48 and having a free distal end 408 and a plurality of side straps 410 connected at a central portion 412 to the bottom portion and having a pair of free distal ends 414. In one embodiment, the side straps 410 have a length 416 greater than a width 418 of the mattress 22. A molded handle 418 may be disposed at the distal end 408, 414 of each strap 404, 410. The molded handle 418 may be configured as having an aperture, as shown in the end straps 404 or a solid raised element, as shown in the side straps 410. Each strap 404, 410 may have a color of safety neon orange, yellow, green, pink or the like, etc. The side straps 410 may extend across the width 418 of the mattress 22 without interference with the air exit holes 82. The straps 404, 410 may be configured from a 2 inch wide nylon webbing in one embodiment. Preferably, in this embodiment, straps 404, 410 are constructed and connected to the mattress 22 in such a manner as to provide additional functionality in a non-inflated state. Namely, an injured person disposed in a difficult to access location or on a non-flat location may be rolled onto the uninflated mattress 22 and the straps 404, 410, especially the side straps 410, may be used to move the person to a safer or different location. From that point, the straps 404, 410 may be used to lift the person to a stretch or other similar transport apparatus as described herein. Without the straps 404, 410, the mattress 22 would fail to function in the manner described with respect to this embodiment since the straps 404, 410 provide the needed additional strength and reinforcement.

Furthermore, while the particular preferred embodiments have been shown and described, it is obvious to those skilled in the art that changes and modifications may be made without departing from the teaching of the disclosure. The matter set forth in the foregoing description and accompanying drawings is offered by way of illustration only and not as limitation. The actual scope of the disclosure is intended to be defined in the following claims when viewed in their proper perspective based on the related art.

What is claimed is:

1. A body transport apparatus comprising: an inflatable air mattress including a top portion and a bottom portion, the bottom portion including a plurality of air exit holes configured to provide an air cushion under the mattress when the mattress is inflated; a cover portion connected to the mattress adjacent to an entire perimeter of the top portion to cooperatively define with the top portion an enclosed volume above the top portion and below the cover portion, the cover portion including a selectively closeable passageway that extends between the enclosed volume and an exterior of the cover portion; a flap defined in the cover portion and including a fold line disposed adjacent the perimeter of the top portion, wherein the flap is movable about the fold line between a first position defining an open configuration to provide access through a defined opening to the enclosed volume and a second position defining a closed configuration to prevent access to the enclosed volume, wherein a closure assembly is connected to a perimeter of the flap and the defined opening that is selectively engagable in a first orientation wherein a first portion of the closure assembly connected to the flap is disconnected from a second portion of the closure assembly connected to the defined opening and a second orientation wherein the first portion is connected to the second portion.

2. The body transport apparatus of claim 1, further comprising a stabilizing board releasably connected to the top portion of the mattress and apparatus for securing a body to the board.

3. The body transport apparatus of claim 1, wherein said mattress includes a marking for indicating that the bottom portion is to be positioned downward.

4. The body transport apparatus of claim 3, wherein said marking includes the bottom portion colored dark relative to the top portion.

5. The body transport apparatus of claim 1, wherein the top portion of the mattress has a color of white for ease of observing fluids.

6. The body transport apparatus of claim 1, wherein the cover portion is opaque.

7. The body transport apparatus of claim 1, wherein the cover portion has a black color.

* * * * *